US005960586A

United States Patent [19]

Chen

[11] Patent Number: 5,960,586

[45] Date of Patent: Oct. 5, 1999

[54] PREFERRED EMBODIMENT OF A CONFIGURABLE, MULTI-PURPOSE WINDOW RAILING TREATMENT WITH ANTI-THEFT PROPERTY

[76] Inventor: Jung-tsung Chen, No. 5, Alley 10, Lane 256, Hai Wei Rd., Long Jing Hsiang, Taichung, Taiwan

[21] Appl. No.: 09/146,775

[22] Filed: Sep. 4, 1998

[51] Int. Cl.[6] ..... A47G 7/00

[52] U.S. Cl. ..... 47/40; 47/68; 211/88.01; 49/50

[58] Field of Search ..... 49/50; 52/79.6, 52/DIG. 17; 47/68, 69, 40, 33, 60, 39; 248/208, 236; 211/88.03, 88.02, 88.01, 87.01

[56] References Cited

U.S. PATENT DOCUMENTS

| | | | |
|---|---|---|---|
| 1,152,899 | 9/1915 | Moore | 47/40 |
| 1,214,057 | 1/1917 | Moore | 47/40 |
| 1,380,237 | 5/1921 | Neff | 47/40 X |
| 1,448,235 | 3/1923 | Read | 52/79.6 X |
| 2,074,872 | 3/1937 | Thorin | 47/40 |
| 3,562,972 | 2/1971 | D'Amato | 52/DIG. 17 X |
| 4,009,546 | 3/1977 | Buck | 47/68 X |
| 4,038,791 | 8/1977 | Atkinson | 47/40 X |

*Primary Examiner*—Jerry Redman

[57] ABSTRACT

The proposed invention pertains to a configurable, mutli-purpose anti-theft window mechanism, particularly referring to an innovative device featuring practical value and economic benefits. The primary components consist of a flower planter railing, a patterned grill, and a weather-shielding canopy making up the structure, via interconnecting easy assembly mechanisms to provide users to choose any of the accessories offered to configure their desired installation with option to add or take away any of the components highlighting flexible, configurable and practical applications.

5 Claims, 4 Drawing Sheets

PREFERRED EMBODIMENT OF A CONFIGURABLE, MULTI-PURPOSE WINDOW RAILING TREATMENT WITH ANTI-THEFT PROPERTY

BACKGROUND OF THE INVENTION

1. Field of the Invention

The proposed invention pertains to a preferred embodiment of a multi-purpose anti-theft window railing design, particularly referring to a mechanism that acts to achieve the objective of flexible adaptation by any users according to their practical demands or for renovation at a later date offering flexibility in assembling or disassembling one or more than one of the parts of an innovative creation that sports practical value with built-in economic fringe benefits.

2. Description of the Prior Art

Inasmuch, in terms of the method of assembly and installation on well-known common window railings or anti-theft windows are concerned, it tends to require measuring the dimensions, fitted, welded and pre-assembled to shape at a manufacturing facility before the finish product is transported to the location of installation to complete the installation. However, in such way, the entire fabrication process is not only somewhat fastidious with longer working time, but the transport and hanging process will also be more complicated (especially in cases of installation at high-rise building, where trolleys are needed to lift the railing up to the floor on which the railings are to be installed). Moreover, once common railings or anti-theft windows have been put into place, the shapes tend to be permanently fixed without any option to change their configuration, thus the consumers are given little else in other options. Thus, common designs have been found to be less efficient as far as meeting the objectives of operating needs or future upkeep when a consumer wishes to add or take away a certain component from the structure. For example, if a consumer has already had a flower planter railing installed in place, but wants to add anti-theft window to the existing device at a later date, the consumer will have to have the existing railing knocked down and removed, and spend another sum of money reinstalling a new anti-theft window. Or an opposite scenario where the existing device could be of an anti-theft window that need be updated due to visual effect or modified into a flower planter railing, or a several structural deterioration that needs to be totally demolished, a consumer will likely have to confront the deficiency of a total demolition or replacement.

SUMMARY OF THE INVENTION

In view of such, the patent inventor, being aware of an array of deficiencies and inconvenience associated with the installation and operation of well-known common flower planter railings or anti-theft windows, has instigated ingenuity with practical know-how by constantly researching for innovative development in an attempt to utilize a configurable design that not only simplifies the installation procedure but also offers many options for consumers to choose freely, with an array of accessories that can be adopted for future renovation highlighting the main objective of this invention.

A fringe benefit of this invention lies in allowing consideration for convenient transport, installation and future maintenance. Thus, a configurable design has been adopted that allows direct assembly of parts and components at a job site so to alleviate any prefabrication or assembly tasks, which further eliminate any need of cumbersome transport maneuvers. In the mean time, should any part of the structure need to be replaced in the future due to vandalism, for example of damaged grills cut by a burglar break-in, an easy partial replacement can be done directly to the damaged area, which not only greatly cuts down the financial strain of a user but also reduces any complication on the maintenance cost.

BRIEF DESCRIPTION OF THE DRAWINGS

To facilitate further understanding of various proposed techniques and their characteristics of the design, backup illustrations are outlined as follows.

DETAILED DESCRIPTION OF THE INVENTION

Figure 1:
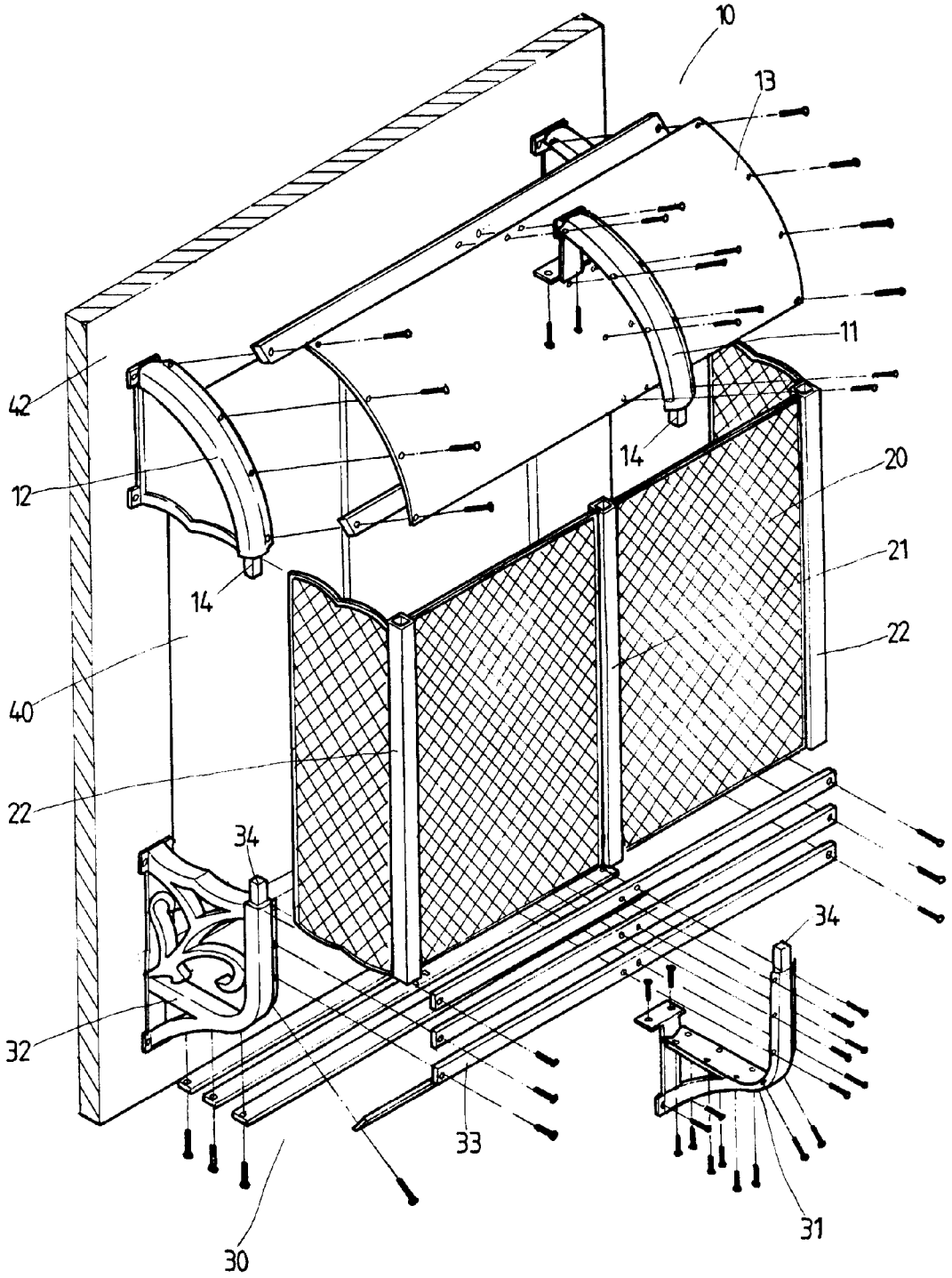
FIG. 1 is an exploded perspective view of the preferred embodiment.
Figure 2:
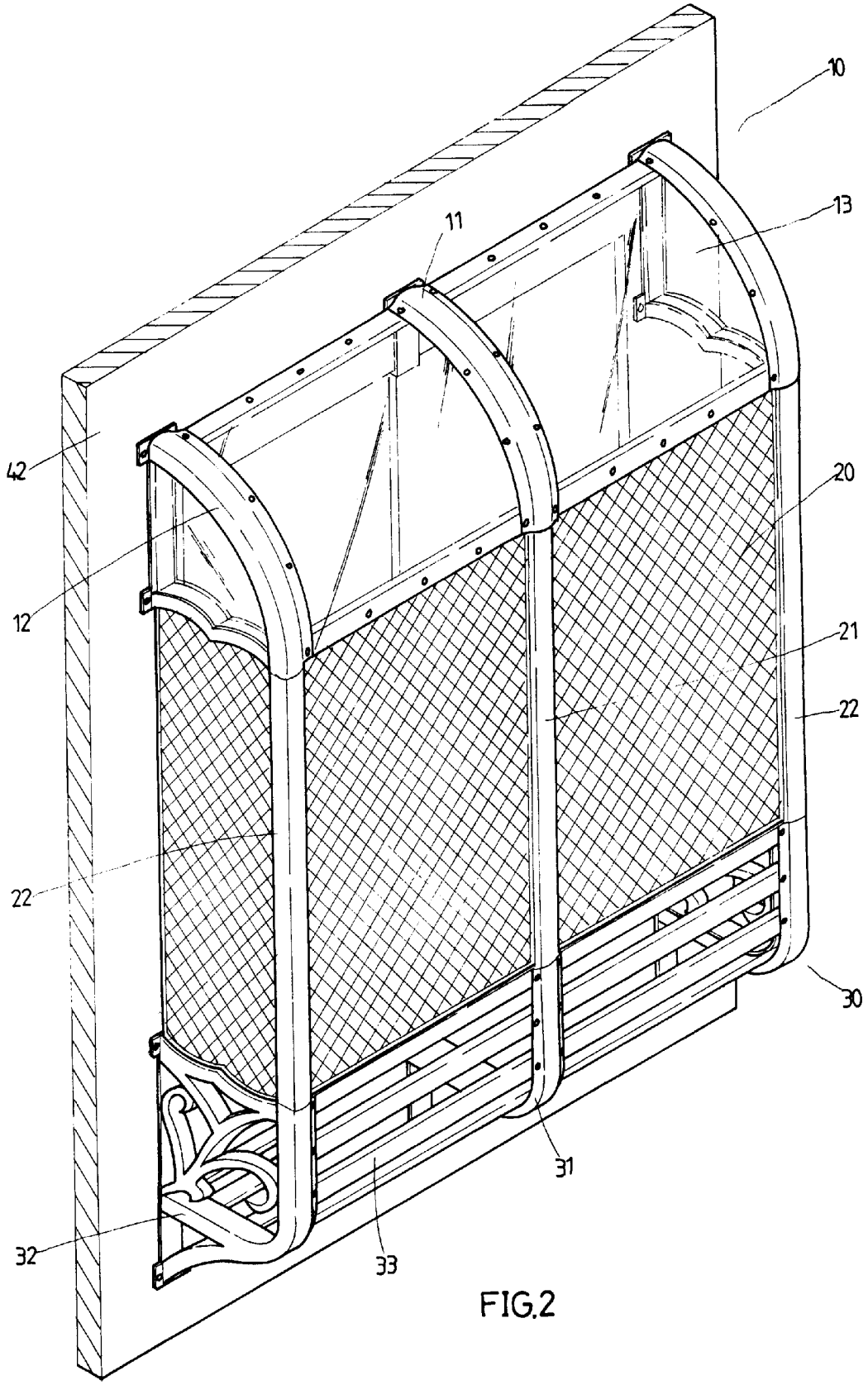
FIG. 2 is an assembled perspective view of the preferred embodiment.

Firstly, please refer to structures disclosed in FIG. 1 and FIG. 2, which include:

A flower planter railing 30, supported by center support beam 31 and two side support wedges 32 anchored against an outer wall with outer edges of a stationery lower window outfit 40 also mounted against an outer wall, and interlaced with several ribs 33.

A patterned window grill 20, which is held by the strength of the center coupling 21 and two side support wedges 22, and attached onto the matching central support beams 11, 31 and two side support wedges 12, 32 between the canopy 10 and the planter railing 30.

A weather-shielding canopy 10, which is held by the one ends of the center support beam 11 and two side support wedges 12 anchoring against the wall and resting against the edges of the window outfit 40 with several cover plates 13 acting as the device that shelters the sun and the rain.

Figure 3:
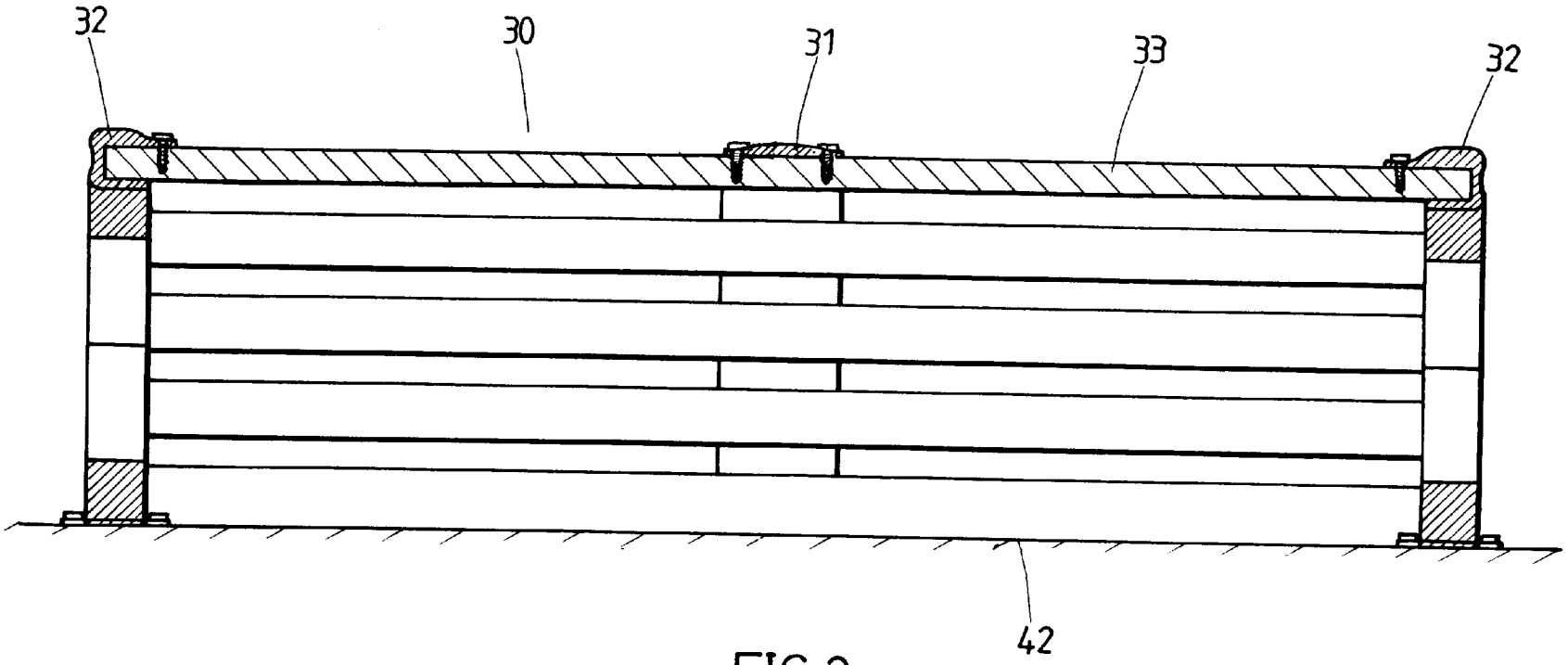
FIG. 3 is a cross-sectional view taken along line III—III in FIG. 2.

Hence, please refer to FIG. 3, the weather-shielding canopy 10, flower planter railing 30 and central support beams 11, 31 and side support wedges 12, 32 are of similar design. On which, the open end of the central support beams 11, 31 are made to step-down squares 14, 34, with the ends of the openings flattened to accommodate several cover plates 13 or ribs 33. The side support wedges 12, 32 are configured in matching semi horseshoe-shaped configuration that accommodates inserting cover plates 13 or ribs 33 through, combined with screws to fasten the structure in place.

Figure 4:
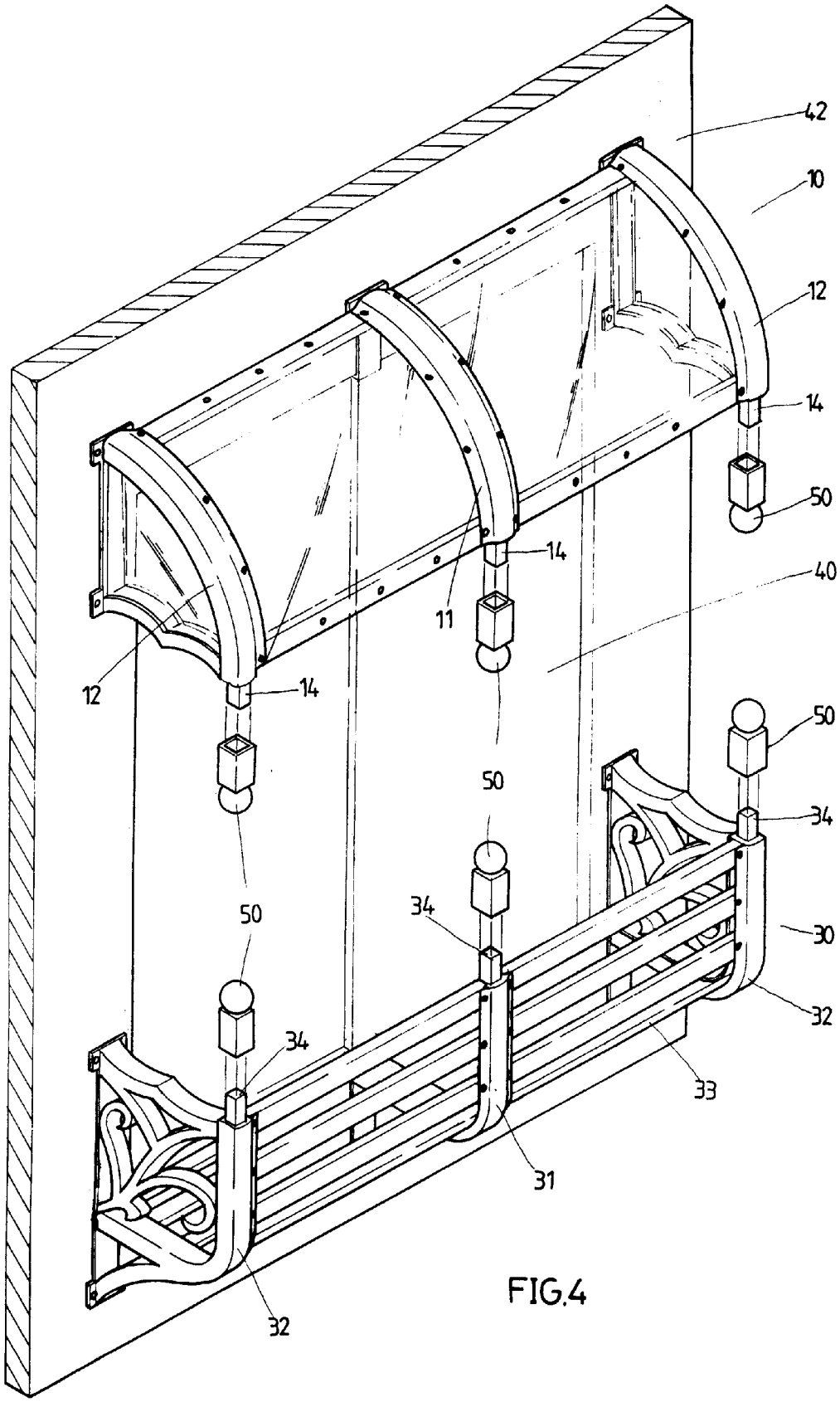
FIG. 4 is an assembled perspective view of another preferred embodiment.

As a result, with the assembly design made from the foregoing mentioned components, a user could either choose and install just the weather-shielding canopy 10, planter railing 30 and/or patterned grill 20, or choose a style doubling the features of a weather-shielding canopy and a flower planter railing as shown in FIG. 4 that not only offers flower pot placement beautifying the building exterior, thus also installation charges. Naturally, an optional patterned grill can be added later on to provide the objective of extra security measure with anti-theft feature. By then, the installer only needs to follow the steps shown in FIG. 2 by removing either the weather-shielding canopy 10, or the flower planter railing 30, inserting the patterned grill's center coupling beams 21 and side coupling beams 22 into the recesses 14, 34 of the center support beams 11, 31 and side support wedges 12, 32 before refastening the canopy 10 or the planter railing. Thus, practicality, convenience and economic benefits can be realized via the proposed mechanism.

Naturally, if a user already has the canopy 10, grill 20 and planter railing 30 installed but wants to remove the grill 20 at a later date, the disassembling procedure will call for removing either the canopy 10 or the planter railing 30, take down the grill 20, then replace either the canopy 10 or the planter railing 30 to complete the job. Similarly, if a certain part is damaged, a partial repair can be applied directly at the damaged area, thus eliminating the need of having the entire window demolished.

Therefore, with a diversified options offer by the invention that provides an array of options in the configuration modes to be implemented, thus all feasible simple substitution or assembly method related to the essence of this preferred embodiment proposed in this patent shall also be covered within the realm of this patent claim.

Recapping the foregoing claims, the preferred embodiment not only contains many advantages as disclosed above, yet none of the features has yet been documented in any published claims prior to the submittal of the patent claim, thus it qualifies to meet the practical value of innovative and progressive features, which are indeed meeting the criteria in applying for a patent for new invention entitled to be protected by the patent Law, hence an application is hereby presented according to applicable proceedings.

I claim:

1. A multi-purpose window railing for a stationary window having top, bottom and opposite sides, and bordered by a surrounding wall, the railing comprising:

a) a flower planter portion extending outwardly from the surrounding wall adjacent to the bottom of the window and having a first center support beam located between two first side support beams and a plurality of spaced apart ribs extending between the first side support beams, and attached to the first side support beams and to the first center support beam, the spaced apart ribs forming a bottom of the flower planter portion;

b) a canopy portion extending outwardly from the surrounding wall adjacent to the top of the window and having a second center support beam located between two second side support beams, and a cover plate extending between the second side support beams, and attached to the second side support beams and the second center support beam; and, c) a mounting square extending from each of the first and second side support beams and center support beams, each mounting square having cross-sectional dimensions smaller than the associated side beam, the mounting squares on the flower planter portion and the canopy portion facing toward each other.

2. The multi-purpose window railing of claim 1, further comprising a patterned window grill having a center coupling beam located between two side coupling beams, each coupling beam having recesses in opposite ends receiving the mounting squares therein to removably connect the patterned window grill to the flower planter portion and the canopy portion.

3. The multi-purpose window railing of claim 1, wherein the cover plate is transparent.

4. The multi-purpose window railing of claim 1, wherein the first center support beam and the two first side support beams each comprise a curved beam extending outwardly and upwardly from the surrounding wall such that each has an upwardly facing end and wherein the mounting squares extend from the upwardly facing ends.

5. The multi-purpose window railing of claim 1, wherein the second center support beam and the two second side support beams each comprise a curved beam extending outwardly and downwardly from the surrounding wall such that each has a downwardly facing end and wherein the mounting squares extend from the downwardly facing ends.

* * * * *